United States Patent [19]

Smith

[11] Patent Number: 4,565,079

[45] Date of Patent: Jan. 21, 1986

[54] DEADBOLT GATE LOCK

[75] Inventor: Robert J. Smith, Detroit, Mich.

[73] Assignee: Smith Locks, Inc., Detroit, Mich.

[21] Appl. No.: 503,516

[22] Filed: Jun. 13, 1983

[51] Int. Cl.[4] ..... E05B 65/06

[52] U.S. Cl. ..... 70/134; 70/360; 70/451; 292/150; 292/337

[58] Field of Search ..... 70/129, 134, 143, 461, 70/447–449, 451, 360, 361; 292/337, 150

[56] References Cited

U.S. PATENT DOCUMENTS

| | | | |
|---|---|---|---|
| 1,736,900 | 11/1929 | Carpenter | 70/360 X |
| 3,334,933 | 8/1967 | Ehlers | 70/129 X |
| 3,668,906 | 6/1972 | Josephart | 70/360 X |
| 3,815,390 | 6/1974 | Stoia | 70/134 |
| 3,934,908 | 1/1976 | Rifkin | 292/150 |
| 3,971,239 | 7/1976 | Lavis | 292/337 X |
| 4,009,599 | 3/1977 | Patriquin | 70/360 X |
| 4,109,949 | 8/1978 | Smith | 292/150 X |

*Primary Examiner*—Kenneth J. Dorner
*Assistant Examiner*—Russell W. Illich
*Attorney, Agent, or Firm*—Cullen, Sloman, Cantor, Grauer, Scott & Rutherford

[57] ABSTRACT

In a deadbolt gate lock having an elongated casing, a manually reciprocal deadbolt mounted within the casing and projectable therefrom, an actuator pin connected to the deadbolt and extending outwardly through an elongated slot in the casing, and a push button plunger lock mounted within the casing having a spring bolt retainingly engageable within the deadbolt for securing the deadbolt in a projected position; the improvement which comprises a pair of spaced aligned spacer blocks snugly nested and retained within the casing, having aligned bores guidably receiving the deadbolt, the blocks retainingly engaging the plunger lock. A removable set screw on the plunger normally prevents its removal from the plunger lock, the casing having an access opening in registry with the set screw when the plunger lock is unlocked.

3 Claims, 9 Drawing Figures

DEADBOLT GATE LOCK

BACKGROUND OF THE INVENTION

Heretofore there has been used deadbolt gate locks including a casing having a manually reciprocal deadbolt mounted therein and projected therefrom together with an actuator pin connected to the deadbolt and extending through an elongated slot in the casing together with a push button plunger lock having a lock cylinder mounted within the casing and some form of detent means engageable with the deadbolt for securing the deadbolt in a locking position. The difficulty with the prior art construction, was that a blow of a hammer to the casing adjacent the plunger lock often causes spring biased plunger thereof to pop up unlocking the deadbolt.

Heretofore gate locks have been so constructed that the deadbolt was accessible by a bolt cutter. Heretofore in some gate lock constructions wherein the plunger lock was secured within the casing it was extremely difficult to remove the cylinder from the plunger of the plunger lock without first removing the complete plunger lock from the casing. Often times this was difficult because the effort needed to obtain access to the interior of the casing and removing the plunger lock without complete disassembly of the lock components.

Heretofore, set screws or pins have been employed for retaining the plunger lock in position within the housing. Such set screws or pins were removable and thus limited the security desired. Heretofore deadbolts and locks of this nature have been die cast and were separatable and could be cut. Heretofore, locks of this type of casings are to some extent hollow and damagable and destroyable by application of a hammer blow thereto.

SUMMARY OF THE INVENTION

An important feature of the present invention is to provide an improved burgler proof gate lock which is both cutter and hammer proof when locked.

It is a further feature to provide an improved deadbolt gate lock which may be applied to wooden doors, metal doors as well as garage doors and having a steel casing that may be welded to metal doors or may be bolted as desired.

Another feature is that the gate lock is hammer proof and is of a solid construction due to the arrangement of the spacers upon the interior of the casing which snugly engage the walls thereof, so that the plunger of the plunger lock will not retract on receipt of a strong blow to the casing.

A further feature includes a deadbolt of steel which is guidably mounted within the casing protectively mounted with respect to a door frame by a strike plate preventing access of a bolt cutter thereto.

An important feature is to provide a solid steel casing within which are positioned a pair of opposed engaging spacer blocks constructed of aluminum snugly filling in most of the space within the casing for guidably mounting the deadbolt therein and for providing the means for securing the plunger lock within the casing.

An object of the present invention is to provide a substantially permanent lock assembly and wherein the end plates of the casing are welded in place rendering the lock substantially indestructible.

Another feature is the provision of set screw or spring biased push pin mounted upon the plunger of the plunger lock normally having an interference fit with the cylindrical lock case and wherein an access opening is provided within the casing for removing the set screw or retracting the push pin to eliminate the interference between the plunger of the plunger lock and its casing so the complete plunger and lock cylinder therein may be easily removed therefrom without otherwise disassembling the gate lock or removing the plunger lock from the casing.

A further feature contemplates the use of an access opening in registry with the set screw or push pin only when the lock is in an unlocked condition.

These and other features and objects will be seen from the following specification and claims in conjunction with the appended drawings.

THE DRAWINGS

Figures 1, 2, 3, 4, 5, 6, 7, 8, 9:
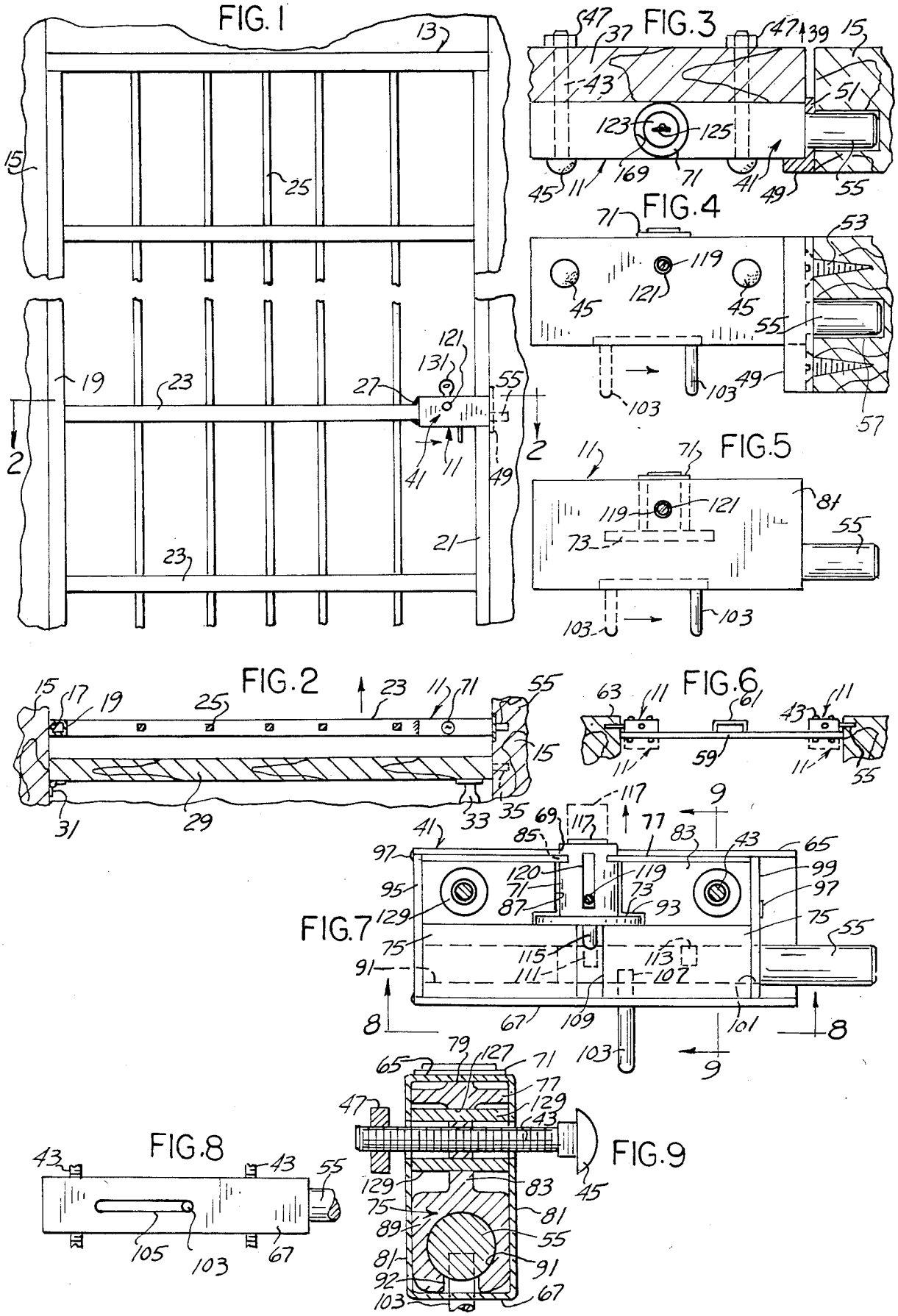
FIG. 1 is a fragmentary side elevational view of a metal gate upon which the present lock is mounted and secured.
FIG. 2 is a fragmentary plan section taken in the direction of arrows 2—2 of FIG. 1.
FIG. 3 is a fragmentary plan view of the present deadbolt gate lock as mounted upon a wood door with the frame partly shown.
FIG. 4 is a side elevational view thereof.
FIG. 5 is a side elevational view of the gate lock shown in FIG. 1 on an increased scale.
FIG. 6 is a schematic plan section showing the mounting of a pair of gate locks upon a garage door within a framework fragmentarily shown.
FIG. 7 is a side view of the gate lock shown in FIG. 4 on an increased scale, with one side wall removed.
FIG. 8 is a bottom plan view of the lock in FIG. 4.
FIG. 9 is a section taken in the direction of arrows 9—9 of FIG. 7, on an increased scale.

It will be understood that the above drawing illustrates merely a preferred embodiment of the invention with variations thereof and that other embodiments are contemplated within the scope of the claims hereafter set forth.

DETAILED DESCRIPTION OF AN EMBODIMENT OF THE INVENTION

Referring to the drawing the present deadbolt gate lock 11 is shown in FIG. 1 and in detail and in section on an increased scale in FIG. 7. Said lock is mounted upon the steel or iron gate 13 within a door frame 15, fragmentarily shown, and hinged at one edge as at 17 to open outwardly, and including tubular rails 19 and 21. A plurality of vertically spaced cross tubes 23 interconnect the guide rails 19 and 21, are suitably secured thereto and are apertured to receive the upright spacer rods 25.

The deadbolt gate lock 11 is secured to the gate 13 at its closing edge within the plane thereof as by the welds 27. In the illustration FIG. 2 upon the interior of the gate 13 is a conventional wood door 29 hinged at one edge at 31 to the frame 15 and having a conventional knob 33 at its closing edge with a conventional latch or bolt 35.

In the illustration shown in FIGS. 1 and 2, the protective wrought iron or other type of gate 13 is arranged within door frame 15 outwardly of the conventional wood door 29, and wherein the present deadbolt gate lock 11 is welded to the gate at its closing edge.

FIG. 3 shows the same gate lock mounted upon wood door 37 which opens inwardly as shown at 39. The present deadbolt gate lock includes the hollow tubular casing 41 preferably constructed of steel and rectangular in cross-section. The casing is bolted to the door, FIGS. 3 and 7 by a pair of fasteners 43 having round heads 45 upon the outside of the door and with nuts 47 upon the interior.

The door 37 and the connected gate lock 11 is positioned within the frame 15, fragmentarily shown, and is adapted for registry with the strike plate 49 having a right angular mount flange 51 suitably secured to the frame 15 by a pair of fasteners 53, such as wood screws. Retractable deadbolt 55, circular in cross-section, and preferably constructed of steel is guidably mounted within the tubular casing 41 and in advanced position extends through the apertured strike plate mount flange and into the corresponding bolt opening 57 within the frame 15, FIG. 4.

The present deadbolt gate lock may be mounted upon the garage door 59, schematically shown in FIG. 6, normally constructed of metal and having a handle 61. The door 59 may be a roll-up door, a swing door or an overhead door. The present gate lock 11 may be mounted upon one side edge of the door 59 or upon both sides either on the exterior in FIG. 6 or upon the interior as shown in dash lines, and is bolted thereto as at 43.

The frame 63 shown in FIG. 6 is suitably apertured or may mount an apertured strike plate 49, 51, such as shown in FIGS. 3 and 4 adapted to receive the corresponding retractable deadbolt 55.

Referring to FIGS. 7 and 9, the casing 41 includes top wall 65, apertured at 69 to receive the push button plunger lock 71. Said cylinder lock includes a cylindrical case having upon its inner end a transverse anchor flange 73. A pair of aligned spacer blocks 75, preferably made of aluminum and nested within the side walls 81 are adapted to retainingly engage the plunger lock case 71 and to guidably support and receive deadbolt 55.

Each spacer block includes a top flange 77 which extends to and snugly engages the side walls 81 of the casing and has a central elongated ridge 79 in snug engagement with top wall 65. Each of the spacer blocks 75 include an elongated base 89, sometimes referred to as a deadbolt guide boss, which is nested within casing 41 and is in snug engagement with the sides 81 and bottom of said casing. Along the top of base 89 is a centrally arranged elongated web 83. Overlying the web as a part thereof is the transverse top flange 77.

The inner end walls 87 of the guide blocks 75 are cut-away from the ends of said guide blocks and are adapted for operative engagement with opposite sides of the case of cylinder lock 71, FIG. 7.

Formed in each of the guide blocks adjacent end walls 87 and between the web 83 and base 89 are a pair of inwardly directed anchor slots 93. These slots are adapted to cooperatively receive the lock flange 73 at the inner end of the cylinder lock case 71 for anchoring the plunger lock assembly within casing 41. At the upper end of the web 83 extending inwardly of the inner end walls 87 thereof, are a pair of oppositely recessed flanges 85 which are adapted to cooperatively engage around exterior wall portions of the cylinder lock case 71, FIG. 7.

Within each of the spacer blocks 75 formed within the base thereof, are the aligned bores 91 adapted to slidably receive the manually retractable deadbolt 55. Each of the bores 91 terminate in the elongated clearance slots 92 adjacent bottom wall 67 and in registry with bottom wall slot 105, FIG. 8.

End plate 95, sometimes referred to as an end wall is of rectangular form and is nested within one end of the casing 41 and secured therein as by the welds 97. Said end plate is in operative retaining engagement with the adjacent spacer block 75, FIG. 7. End plate 99, also rectangular in shape and having a bolt aperture 101 therethrough is nested within the other end of casing 41 and welded thereto at 97.

Bolt actuator pin 103, preferably constructed of brass, extends through the casing bottom wall slot 105, FIG. 8, through the spacer slots 92 and is press fitted into a corresponding undercut slot 107 within deadbolt 55. Bolt actuator pin 103 is therefore adapted for manual movement along the length of the slot 105 for moving the deadbolt to the advance position shown in the drawing or for retraction within the casing 41.

With the end walls 87 of the web 83 in operative engagement with the cylinder lock 71, FIG. 7, the inner ends 109 of the spacer blocks are spaced apart providing a clearance opening for the spring bolt 115 therebetween which forms a part of the plunger lock assembly 71.

Formed within the top of the deadbolt are a pair of deadbolt lock recesses 111 and 113 adapted for alternate registry with the spring bolt 115 when the deadbolt is either in the advance position shown in FIG. 7 or retracted within said casing so that the aperture 113 is in registry with spring bolt 115 sometimes referred to as a pin tumbler or plunger pin. Bolt actuator pin 103 therefore serves a second function of maintaining the apertures 111 and 113 in upright position so as to at all times be in selective registry with the pin tumbler 115.

The end wall 99 or apertured end plate is snugly positioned within casing 41 in operative engagement with one end adjacent the spacer block 75. End plate 99 operatively retains the spacer block so that it is in retaining engagement with case 71 of the cylinder lock assembly.

The plunger lock assembly including its case 71, also includes a reciprocal spring biased plunger 117 nested within said case and from which depends spring bolt 115. When the plunger 117 is manually moved inwardly to a lock position, the spring bolt against the action of its biasing spring, moves axially downward into one of the deadbolt recesses 111 and 113 for retaining the deadbolt either in the advance locking position shown in FIG. 7 or in a retracted position.

A conventional lock cylinder 123, FIG. 3, having a key aperture 125 is normally nested and retained within plunger 117 so that its outer end is flush with the outer end of said plunger, FIGS. 4 and 7. Mounted upon the plunger 117 projecting radially outward therefrom is a set screw 119 which is guidably positioned through an elongated slot 120 within case 71 of FIG. 7. It is regarded as equivalent to the set screw 119, that there be employed instead a spring biased push pin mounted upon the plunger 117 and retractably positioned within slot 120.

The set screw 119 or equivalent spring biased push pin is slidable within slot 120 and in the spring biased release position shown in dash lines, FIG. 7, is in interference engagement with the casing 71. This normally prevents disassembly of plunger 117 from said lock case 71.

Formed within one of the side walls 81 of the casing there is provided an access opening 121, FIGS. 4 and 5 which is in registry with the set screw 119, or push pin only when the plunger 117 is retracted from the cylinder case in an unlocked position with the set screw 119 in registry with access opening 121. The set screw may be manipulated by a screw driver for removal so as to eliminate the interference between the plunger and the cylinder case and to permit easy removal of plunger 117 from case 71.

Instead of a set screw, if a spring biased push pin is employed manually projecting the push pin inwardly also would eliminate the interference between the plunger and the cylinder case and permit its removal. Thus, the push button plunger lock can be easily changed on the job for a different key combination by removing the set screw 119 on the side of the casing when the push button plunger is in its unlocked position. Thus, the plunger 117 is easily removed and permits removal of the interior lock cylinder 125 which can be replaced for a different combination to receive the key 131.

In operation, when the cylinder and plunger 117 are depressed inwardly, the corresponding spring bolt 115 or pin tumbler projects within one of the deadbolt apertures 111 and 113 and locks in that position. Thus, the cylinder lock will secure the deadbolt 155 in locking position shown with the spring bolt 115 within spring bolt aperture 111. When deadbolt 55 is fully retracted, its aperture 113 is in registry with spring bolt 115 so as that the plunger lock will anchor the deadbolt 55 in its retracted position.

The plunger 117 and the associated spring bolt 115 is released merely by turning the key 131 and the associated cylinder 125 and the spring biased spring bolt 115 automatically retracts under the action of a coil spring upon the interior of spring case 71. In many situations, the casing constructed of steel is welded to a gate 13 as at 27, FIGS. 1 and 2 or to any other steel door as in FIG. 5 or is bolted to a door including the wood door 37, FIG. 3 or the garage door 59 of FIG. 6, using a plurality of fasteners 43.

When the gate lock assembly is to be bolted to a door, there is provided a pair of transverse bores 127 through the corresponding webs 83 within which snugly project a pair of steel spacer and reinforcing sleeves 129, FIGS. 9 and 10 which cooperatively engage the opposing side walls 81. This reinforces the walls of the casing and prevents any collapsing thereof upon tightening of the fasteners 43.

Due to the symmetry of the present lock assembly it is reversible end to end as desired. It is contemplated under some circumstances that the slot 105 within the bottom wall 67 could be applied to one of the side walls 81 adjacent to and outwardly of deadbolt 55, with the corresponding plunger pin 103 projected through such slot and into deadbolt 55. This would be an equivalent construction, since the plunger pin would perform the same function as if it were in the downwardly depending position, FIG. 7. The present deadbolt gate lock is burgler proof and is of a solid construction, not hollow. The deadbolt is of solid steel, not die cast.

Having described my invention, reference should now be had to the following claims.

I claim:

1. In a deadbolt gate lock having an elongated casing, a manually reciprocal deadbolt guidably mounted within said casting and projectable therefrom to a lock position, an actuator pin connected to said deadbolt and extending outwardly through an elongated slot in said casing, and a push button plunger lock mounted within said casing and having a spring bolt retainingly engageable with said deadbolt for securing said deadbolt in projected position;

the improvement comprising a pair of spaced aligned spacer blocks snugly nested and retained within said casing, having aligned bores guidably receiving said deadbolt, said blocks retainingly engaging said plunger lock;

said push button plunger lock including a cylindrical case and a transverse anchor flange at one end;

said spacer blocks having formed within their inner edges opposed elongated slots retainingly receiving said flange;

said spacer blocks at their inner ends being cut away so as to cooperatively receive and operatively engage opposite sides of said cylindrical case;

said spacer blocks having outwardly opening clearance slots along their length cooperatively receiving said actuator pin;

said casing having top, bottom, side and end walls;

each of said spacer blocks having an elongated base of rectangular cross-section engageable with said side and bottom walls and one end wall;

a central upright elongated web along the top of said base engageable with one end wall;

and a top transverse flange upon and along said web engageable with said side and top walls and one end wall.

2. In the gate lock of claim 1, said casing adapted for mounting upon a door at its closing edge;

a pair of longitudinally spaced sleeves extending transversely through the webs of said spacer blocks respectively, said sleeves at their ends cooperatively engaging said side walls;

and fasteners extending through apertures in said casing side walls and through said sleeves adapted for securing connection to said door.

3. In the gate lock of claim 1, said push button plunger lock comprising a push button plunger and anchor means mounted upon said plunger extending radially outward thereof through an elongated slot in said cylindrical case, said anchor means having an interference engagement with said cylindrical case when in an extended position limiting outward movement of said push button plunger relative to said cylindrical case;

there being an access aperture in said casing and in registry with said anchor means when extended;

said anchor means adjustable inwardly of said case to eliminate the interference engagement so that said push button plunger may be withdrawn from said plunger lock case.

* * * * *